US008990966B2

(12) United States Patent
Von Furstenberg et al.

(10) Patent No.: US 8,990,966 B2
(45) Date of Patent: Mar. 31, 2015

(54) MEDICAL GARMENT

(75) Inventors: Diane Von Furstenberg, New Milford, CT (US); Erin Przekop, New York, NY (US); Jeanne M. Ryan, Chesterland, OH (US)

(73) Assignees: Diane Von Furstenberg Studio, L.P., New York, NY (US); The Cleveland Clinic Foundation, Cleveland, OH (US)

( * ) Notice: Subject to any disclaimer, the term of this patent is extended or adjusted under 35 U.S.C. 154(b) by 367 days.

(21) Appl. No.: 12/974,270

(22) Filed: Dec. 21, 2010

(65) Prior Publication Data

US 2012/0151658 A1 Jun. 21, 2012

(51) Int. Cl.
*A41D 13/12* (2006.01)

(52) U.S. Cl.
CPC ..... *A41D 13/1236* (2013.01); *A41D 13/129* (2013.01); *A41D 2200/10* (2013.01)
USPC ..... 2/83; 2/114

(58) Field of Classification Search
USPC ..... 2/114, 227, 83, 121, 78.4, 96, 104, 270, 2/309, 311; 128/849, 852, 855, 856, 873, 128/874
See application file for complete search history.

(56) References Cited

U.S. PATENT DOCUMENTS 2,846,686 A * 8/1958 Tames ..... 2/114
3,011,172 A 12/1961 Tames
3,369,256 A 2/1968 Kern
3,470,568 A * 10/1969 Belkin ..... 2/114
3,729,747 A * 5/1973 Belkin ..... 2/114
3,935,596 A * 2/1976 Allen et al. ..... 2/114
3,977,025 A * 8/1976 Horan ..... 2/114
4,000,521 A * 1/1977 Zoephel et al. ..... 2/114
4,040,124 A 8/1977 Zoephel
4,040,418 A * 8/1977 Collins ..... 128/852
4,171,542 A * 10/1979 Cox et al. ..... 2/51

(Continued)

FOREIGN PATENT DOCUMENTS

WO WO03063624 8/2003

OTHER PUBLICATIONS

Lagnado, "The Hosptial Gown, Fashion Malady, Worries Would-Be Redesigners Sick, Style Statement vs. Cost Savings; 'We Have Created a Product Nobody Likes'," The Wall Street Journal, May 11, 2009 (3 pages).

(Continued)

*Primary Examiner* — Andrew W Collins
(74) *Attorney, Agent, or Firm* — Myers Wolin, LLC

(57) ABSTRACT

A medical garment formed of a central body region and two side regions with a pair of belts and a pair of fasteners for securing the garment around a patient's body is provided. The central body region may be worn on the back or front and may have a v-neck form. A waistband extends across the central body region and across one side region with a first belt secured at the junction of the central region and the second side region and extending to the outer edge of the first side region. The second belt extends from the secured end of the first belt through the waistband across the central body region, the second belt exiting the waistband at the junction of the second side region and central body region. A first fixed tie is positioned at the outer edge of the second side region along the position of the waistband. A second fixed tie is secured to the inside of the waistband between the central body region and first side region. This garment design allows for easy gathering of fabric to present a secure and attractive body covering.

20 Claims, 6 Drawing Sheets

(56) References Cited

U.S. PATENT DOCUMENTS

| | | | | | |
|---|---|---|---|---|---|
| 4,384,370 | A | * | 5/1983 | Singer | 2/114 |
| 4,395,782 | A | * | 8/1983 | Reynolds | 2/114 |
| 4,466,137 | A | * | 8/1984 | Carnaghi | 2/237 |
| 4,535,481 | A | * | 8/1985 | Ruth-Larson et al. | 2/114 |
| 4,570,268 | A | * | 2/1986 | Freeman | 2/114 |
| 4,578,825 | A | | 4/1986 | Vote | |
| 4,674,132 | A | * | 6/1987 | Stein et al. | 2/114 |
| 4,685,454 | A | * | 8/1987 | Posey | 128/873 |
| D305,575 | S | | 1/1990 | Gordon et al. | |
| 4,920,578 | A | | 5/1990 | Janzen et al. | |
| 4,964,173 | A | | 10/1990 | Gordon et al. | |
| 4,975,984 | A | * | 12/1990 | Sting | 2/114 |
| 5,050,243 | A | * | 9/1991 | Udell | 2/114 |
| 5,184,351 | A | | 2/1993 | Benstock | |
| 5,208,918 | A | | 5/1993 | Royal | |
| 5,228,141 | A | | 7/1993 | Remsky et al. | |
| 5,361,414 | A | * | 11/1994 | Smith | 2/114 |
| 5,572,742 | A | * | 11/1996 | McFadden | 2/114 |
| 5,652,962 | A | * | 8/1997 | Patnode | 2/114 |
| 5,862,525 | A | * | 1/1999 | Tankersley et al. | 2/243.1 |
| 5,946,722 | A | | 9/1999 | Trautmann | |
| 5,991,923 | A | * | 11/1999 | Maria | 2/83 |
| 6,115,839 | A | * | 9/2000 | Covington et al. | 2/69 |
| 6,134,715 | A | | 10/2000 | McLennan | |
| 6,216,271 | B1 | * | 4/2001 | Chen | 2/69 |
| 6,237,153 | B1 | * | 5/2001 | Bowens | 2/114 |
| 6,378,136 | B2 | * | 4/2002 | Matsushita | 2/114 |
| 6,484,321 | B1 | | 11/2002 | Shamam | |
| 6,851,125 | B2 | * | 2/2005 | Fujikawa et al. | 2/51 |
| 7,424,750 | B2 | * | 9/2008 | Kerr | 2/114 |
| 2001/0044948 | A1 | | 11/2001 | Tolson | |
| 2003/0126668 | A1 | | 7/2003 | Scroggins | |
| 2007/0130668 | A1 | * | 6/2007 | Berman et al. | 2/114 |
| 2008/0000006 | A1 | * | 1/2008 | Ochoa et al. | 2/114 |
| 2009/0094729 | A1 | * | 4/2009 | Lin et al. | 2/114 |
| 2010/0050315 | A1 | * | 3/2010 | Christou-Kelly et al. | 2/114 |

OTHER PUBLICATIONS

"Bold Thinking May Finally Improve the Patient Gown," printout from http://www.medgadget.com/archives/print/007715print.htm., May 15, 2009 (3 pages).

* cited by examiner

MEDICAL GARMENT

BACKGROUND OF THE INVENTION

The application relates generally to a medical garment, and more particularly to an adjustable medical garment with improved belt features for concealing a patient's body and providing an attractive appearance while allowing access for medical reasons.

Medical garments or gowns used by medical facilities are known, and may take a variety of forms. They may be made from a variety of materials, and are provided with various forms of securing means. It is desirable to have a medical garment that is suitable for patients of varying size and shape, yet provides adequate access for medical exams and provides a pleasing appearance to help improve a patient's mental state.

Many current medical gowns are based on nightshirts worn in hospitals in the $19^{th}$ century, though the present-day versions often have an opening in the back. The gown is typically secured in the back, making it difficult for a user to secure without assistance. Such designs are also not considered attractive by most users and may serve to make a user mentally and/or physically uncomfortable during wear.

U.S. Pat. No. 3,011,172 issued 5 Dec. 1961 to Daniel Tames and titled "Surgical gown with moisture-proof conductive grounding means", discloses a surgical gown with a central panel having a moisture-proof conductive grounding sheet secured thereto and two side panels. One side panel overlaps the other side panel when the gown is worn. A waist band for a tape or belt extends across the grounding sheet and a side panel with slits at the juncture of the central panel and one side panel and the edge of the of the other side panel to provide access to the tape for securing the gown when worn. U.S. Pat. No. 4,040,124, issued 9 Aug. 1977 to Richard L. Zoephel and titled "Hospital gown having fitting means", discloses an adjustably-fitting hospital gown with portions of fabric coated or impregnated with cohesive-adhesive material which has affinity only to itself. This allows closure and close fitting of all areas desired to be adjustably fitted. U.S. Pat. No. 6,134,715, issued 24 Oct. 2000 to Jane L. McLennan and titled "Medical patient gown", shows a patient gown formed from a single piece of fabric for wrapping about a patient. This gown can be worn forward or backward.

While there are a wide variety of medical gowns available, it is desirable to provide a medical garment that is attractive, yet easily secured around a patient's body to conceal the patient's body while allowing access to the body by medical personnel.

SUMMARY OF THE INVENTION

A medical garment formed of a central body section or panel and two side sections or panels with two independent belts and an inner tie for securing the garment when worn is provided. The central body panel may be worn on the back or front and may have a v-neck form. A waistband extends across the central body panel and one side panel. A first belt in the waistband is secured at the junction of the central body panel and one side panel and exits the waistband at the outer edge of the side panel. The second belt extends from the secured end of the first belt through the waistband across the central body panel exiting at the outside of the junction of the second side panel and central body panel. A first securement member positioned at the outer edge of the second panel along the position of the waistband to cooperate with a second securement member secured to the inside of the waistband between the body panel and first side panel. In exemplary embodiments, the two securement members are fixed ties, or hook and loop fasteners.

This construction allows a patient to tie the two fixed ties to secure the garment about her body with the second side panel in place and then wrap the first side panel over the second side panel and secure it by tying the first belt in the first side panel to the second belt in the waist-band exiting at the second side of the central body panel. This allows the second belt to cause the central body panel to gather about the patient's body. Passing the first belt through the waistband allows the patient to gather excess material in the first side panel and provide an attractive gown. The configuration allows a patient to secure the ties and belts of the gown at one side regardless of whether the central body panel is worn on the front or back of the patient.

The gown may be formed from a single piece of fabric, or from a single piece of fabric cut into panels to provide the separate sections or panels. In a preferred embodiment the panels are individual pieces of fabric secured together by stitches. Sleeves are formed between the central body panel and the side panels and have closeable fasteners to allow access to the patient's arms. Pockets may be provided between the panels below the waistband. Additional pockets may be provided on the central body and side panels.

Accordingly, it is an object of the invention to provide an improved adjustable medical garment.

BRIEF DESCRIPTION OF THE DRAWINGS

For a fuller understanding of the invention, reference is made to the following description taken in connection with the accompanying drawings, in which.

DETAILED DESCRIPTION OF THE INVENTION

Figure 1:
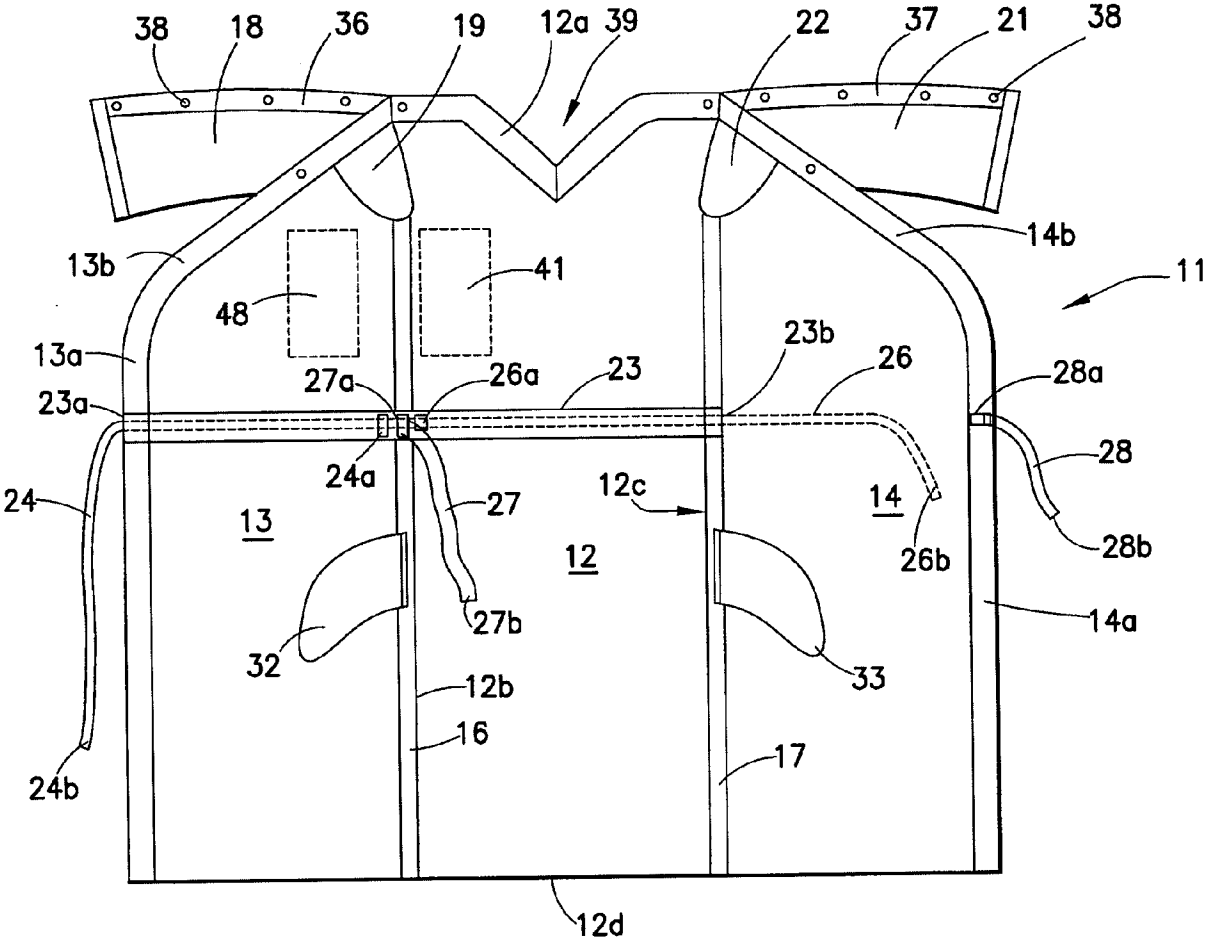
FIG. 1 is an inside plan view of a medical garment according to an embodiment of the invention.

A medical garment or gown 11 constructed and arranged in accordance with the invention is shown in FIG. 1. Here, gown 11 is shown in an open configuration. Gown 11 is formed from a middle or central body region or panel 12 having a first side edge 12*b* and an opposed second side edge 12*c*, a first side region or panel 13 and a second side region or panel 14. First side panel 13 with an outer edge or placket 13*a* and an inner edge 13*b* is joined to first edge 12*b* of central body panel 12 along a first seam 16. Second side panel 14 with an outer edge or placket 14*a* and an inner edge 14*b* is joined to the other side of central body panel 12 at second edge 12*c* by a second seam 17. Gown 11 has a first sleeve 18 formed between, and joined to central body panel 12 and first side panel 13 at a first armhole 19. A second sleeve 21 is formed between the opposite side of central body panel 14 and second side panel 12 at a second armhole 22. All joints and seams of gown 11 are depicted herein as being sewn, but may be joined in any convenient form, such as by stitches, glue, any of a variety of fasteners, or the like. The gown 11 is depicted or described herein as being a medical gown, presumably for use in hospital, nursing home, or other health-care settings, but is also suitable for use in health spas, beauty salons, private homes, or any other suitable use environment wherein a wearer (referenced herein as a patient) desires, or is required to, wear a garment having the characteristics of the gown 11.

Gown 11 may be formed of any suitable natural or synthetic fabric material, such as, but not limited to, polyester, acrylic, polyamide or polyolefin fiber, a blend of these, or any other suitable material or combination of materials. The material may be woven, knit, non-woven or formed in any other manner. The gown 11 can be made substantially of a single piece of material or may instead be formed from separate pieces of material. The material and structure should be selected to withstand the rigors of use and multiple washings for reuse in hospitals, doctor's offices and the like.

Central body panel 12 is substantially rectangular with an upper hem or placket 12*a*, first side 12*b* and second side 12*c*, and a lower hem or placket 12*d*. First seam 16 and second seam 17 represent two outer vertical sides 12*b* and 12*c* of the rectangle. Central body panel 12 also includes a v-neck region 39 along upper hem 12*a*. The upper portions of sides 12*b* and 12*c* of central body panel 12 are cut to form armholes 19 and 22.

Figure 3:
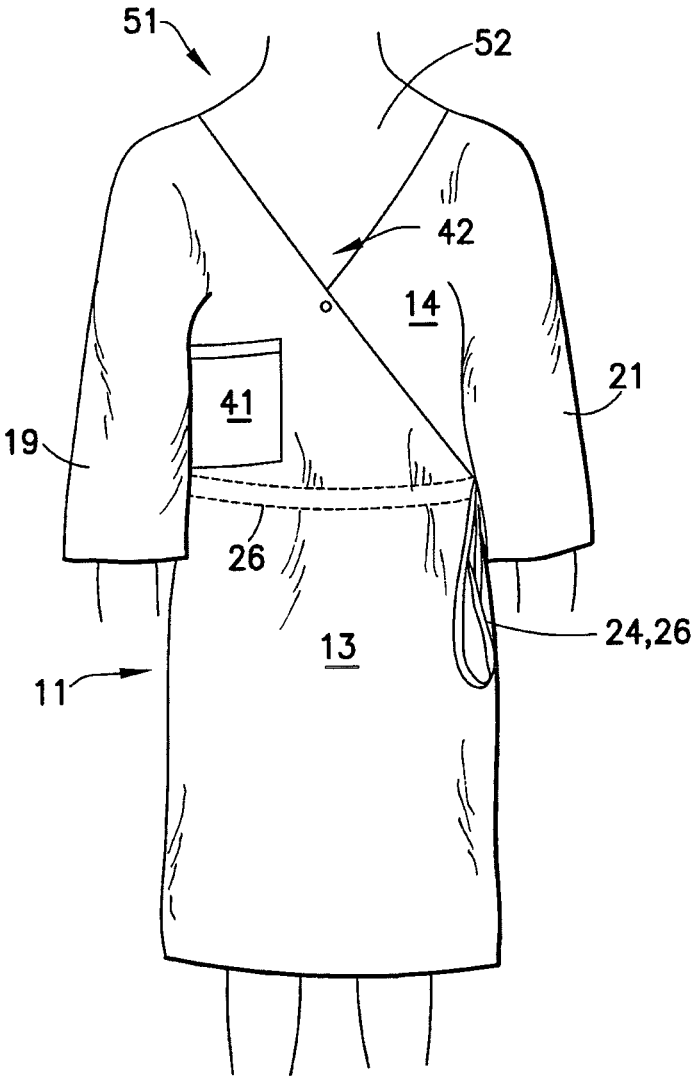
FIG. 3 is a front view of the garment of FIGS. 1 and 2 being worn by a patient with the central panel worn on the patient's back.

First side panel 13 and second side panel 14 are also substantially rectangular with upper inclined sections 13*b* and 14*b*. When the gown 11 is being worn, overlapped inclined sections 13*b* and 14*b* cooperatively form a v-neck 51 as shown in FIG. 3. V-neck 51 is located on the patient's front or back, depending how gown 11 is worn. The inner edges of first and second side panels 13 and 14 are cut similarly to the upper portions of sides 12*b* and 12*c* of central body panel 12 to complete the formation of armholes 19 and 22.

Gown 11 includes a waistband 23, which is a tunnel-like area having multiple layers of material, extending across the inside of central body panel 12 and first side panel 13 between outer edge 13*a* of first side panel 13 and vertical side 12*c* of central body panel 12. Waistband 23 has a first opening 23*a* at outer edge 13*a* of first side panel 13 and a second opening 23*b* at second seam 17. Waistband 23 is located at a "height" (i.e., distance between the upper hem 12*a* and lower hem 12*d*) which at least roughly corresponds to an expected waist location of the patient.

A first belt 24 with a first end 24*a* longitudinally spaced from a second end 24*b* is anchored via the first end 24*a* at first seam 16 and at least a portion of the first belt 24 extends through waistband 23. Second end 24*b* of first belt 24 exits and extends from waistband 23 at outer edge 13*a* of first side panel 13. A second belt 26 with a first end 26*a* longitudinally spaced from a second end 26*b* is anchored via first end 26*a* at first seam 16 and at least a portion of the second belt 26 extends through waistband 23 across center body panel 12. Second end 26*b* of second belt 26 exits and extends from waistband 23 at the outside of gown 11 at second seam 17 via opening 23*b* in seam 17.

This belting arrangement allows first and second belts 24 and 26 to cinch or gather the material of first side panel 13 and central body panel 12 around a patient when second end 24*b* of first belt 24 is tied to second end 26*b* of second belt 26. More specifically, when tensioned, first belt 24 acts in a "drawstring" manner through interaction with waistband 23 to gather the material of first side panel 13 as second belt 26 acts similarly to gather the material of central body panel 12 when belts 24 and 26 are tied together as will be described in more detail below. This makes gown 11 adjustable as it can be used by patients of varying sizes. When two belt "ends" are described as being "tied together", one of ordinary skill in the art will understand that a portion of the belt adjacent those "ends" is involved or implicated in the tying process and that "end" is used herein, in describing a tied connection, as an indicator of the general area of the belt which is being tied.

In addition to first belt 24 and second belt 26 both fixed at seam 16, gown 11 includes a first tie 27 with a first end 27*a* longitudinally spaced from a second end 27*b* with first end 27*a* secured to the inside of gown 11 at first seam 16, at approximately the same height as waistband 26 in proximity to where first belt end 26*a* and second belt end 27*a* are fixedly secured in waistband 23.

A second tie 28 with a first end 28*a*, longitudinally spaced from a second end 28*b*, is secured at first end 28*a* to second side panel 14 at outer edge 14*a* at the height of waistband 23. Second ends 27*b* and 28*b*, respectively, of first and second ties 27 and 28 may be tied together to help secure the gown 11 around the patient, in cooperation with the drawstring-type cinching and securement provided by the first and second belts 24 and 26. While first and second belts 24 and 26 and first and second ties 27 and 28 are described as shown in FIG. 1, it is contemplated that waistband 23 may instead span central body panel 12 and second side panel 14 and the belts and ties would accordingly be positioned in a mirror image fashion to that shown in the Figures.

Gown 11, as shown in the Figures, also includes a first side pocket 32 at first seam 16 and a second side pocket 33 at second seam 17. A central body panel pocket 41 is formed on the outside surface of central body panel 12.

First sleeve 18 and second sleeve 21 are formed with a first sleeve slit and a second sleeve slit, 36 and 37, respectively, across the top of each sleeve. Each of the first and second sleeve slits 36, 37 includes a plurality of fasteners 38 therealong. Here, fasteners 38 are shown as snaps, but may be coordinating hook-and-loop fasteners (e.g., Velcro™), buttons, or any other suitable fasteners. Fasteners 38 allow ready access through the first and second sleeve slits 36 and 37 to the patient's arms by medical personnel.

Figure 2:
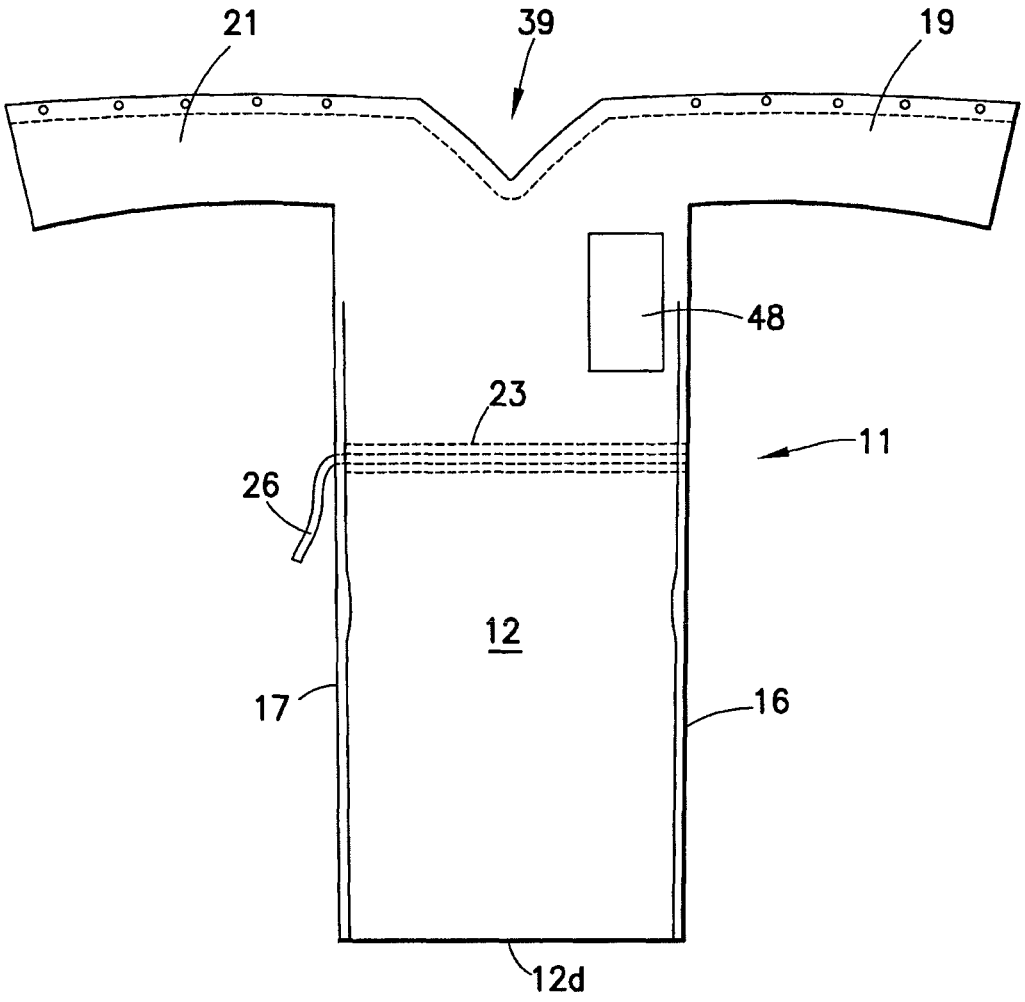
FIG. 2 is a partial plan view of the outside or central body panel of the garment shown in FIG. 1.

FIG. 2 shows the outside of central body panel 12 folded at seams 16 and 17 with first side panel 13 overlapping second side panel 14, and both first and second side panels 13 and 14 being concealed from view underneath central body panel 12 in the arrangement of FIG. 2. The configuration shown in FIG. 2 may be a front or back view of gown 11, depending upon how the gown 11 is donned by the patient. Upper hem 12*a* of central body panel 12, may include v-neck section 39. When gown 11 is worn by the patient with central body panel 12 to the patient's back, side body panel pocket 48 is a breast pocket as shown in FIG. 3. Central body panel pocket 41 may be provided on the outside surface of central body panel 13 to provide a breast pocket when central body panel 12 is worn to the patient's front as shown in FIG. 2.

When gown 11 is to be donned, the patient places one of her arms in each of first and second sleeves 18 and 21 and pulls second side panel 14 around her body. The patient then ties second end 27*b* of first tie 27 and second end 28*b* of second tie 28 together to begin to secure gown 11 about her body. Regardless of whether central body panel 12 becomes the front or back of gown 11, first and second ties 27 and 28 are secured at the patient's side. This side tying for the initial securement makes wearing gown 11 much simpler and more convenient for the patient or a caregiver than for the patient to don a gown, such as a conventional hospital gown, having a rear opening that must be tied at the patient's back. After first and second ties 27 and 28 are secured together to secure the second side panel 14 to the junction of the first side panel 13 and the center panel 12, first side panel 13 is pulled across the patient's body to cover tied first and second ties 27 and 28 and to overlap second side panel 14, then first belt 24 and second belt 26 are tied together on outside of the gown 11 and at the patient's other side, opposite tied first and second ties 27 and 28. Once first and second ties 27 and 28 and first and second belts 24 and 26 are secured together, the material of center panel 12 and first and second side panels 13 and 14 may be gathered around waistband 23 in a drawstring-like manner and arranged to provide the patient with an attractive and relatively form-fitting covering.

FIG. 3 shows a patient 51 with her front 52 facing forward wearing gown 11 with central body panel 12 worn on the patient's back and second end 24*b* of first belt 24 tied to second end 26*b* of second belt 26 at the patient's left side. The ease with which first side panel 13 ruches when first and second belts 24 and 26 are tied illustrates the attractiveness and form-fitting ability of gown 11. Second side panel 14 is draped across patient's front and tied at the right side, then the first side panel 13 is overlapped with the second side panel 14 and tied on the left side. Side body panel pocket 48 is positioned as a breast pocket.

Figure 4:
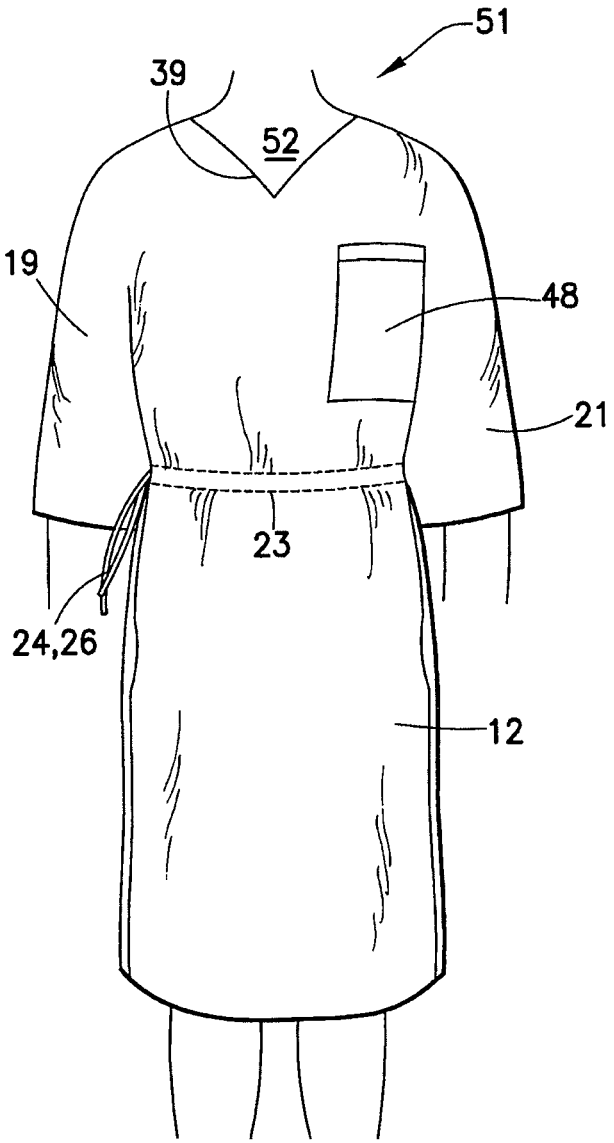
FIG. 4 is a front view of the garment of FIGS. 1 and 2; with the central panel worn on the patient's front.

FIG. 4 also shows patient 51 with her front 52 facing forward but with central body panel 12 to the patient's front. This shows the outer surface of central body panel 12 with central body panel pocket 48 on her left side. In the configuration of FIG. 4, gown 11 is worn "backward" by patient 51 compared with the configuration of FIG. 3. First and second belts 24, 26 are now tied on the right side of patient 51. The ease with which the material about waistband 23 is gathered shows the attractive and form-fitting way in which gown 11 can be worn.

Figure 5:
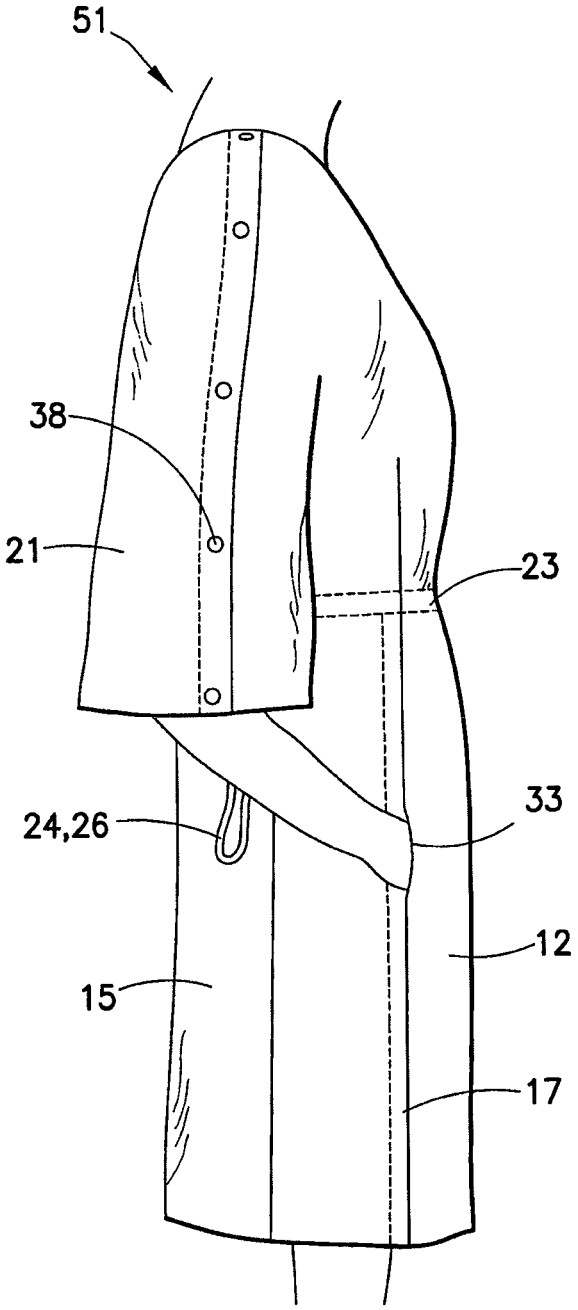
FIG. 5 is a right side view of the garment of FIGS. 1 and 2 worn by the patient as shown in FIG. 4.

FIG. 5 is a right side view of patient 51 wearing gown 11 in a closed condition and in the "backward" configuration of FIG. 4. Here, second sleeve 21 is on the right arm or patient 51 and is shown with fasteners 38 along first sleeve slit 37 in a closed condition. Patient 51 is shown with her right hand in second side pocket 33.

Figure 6:
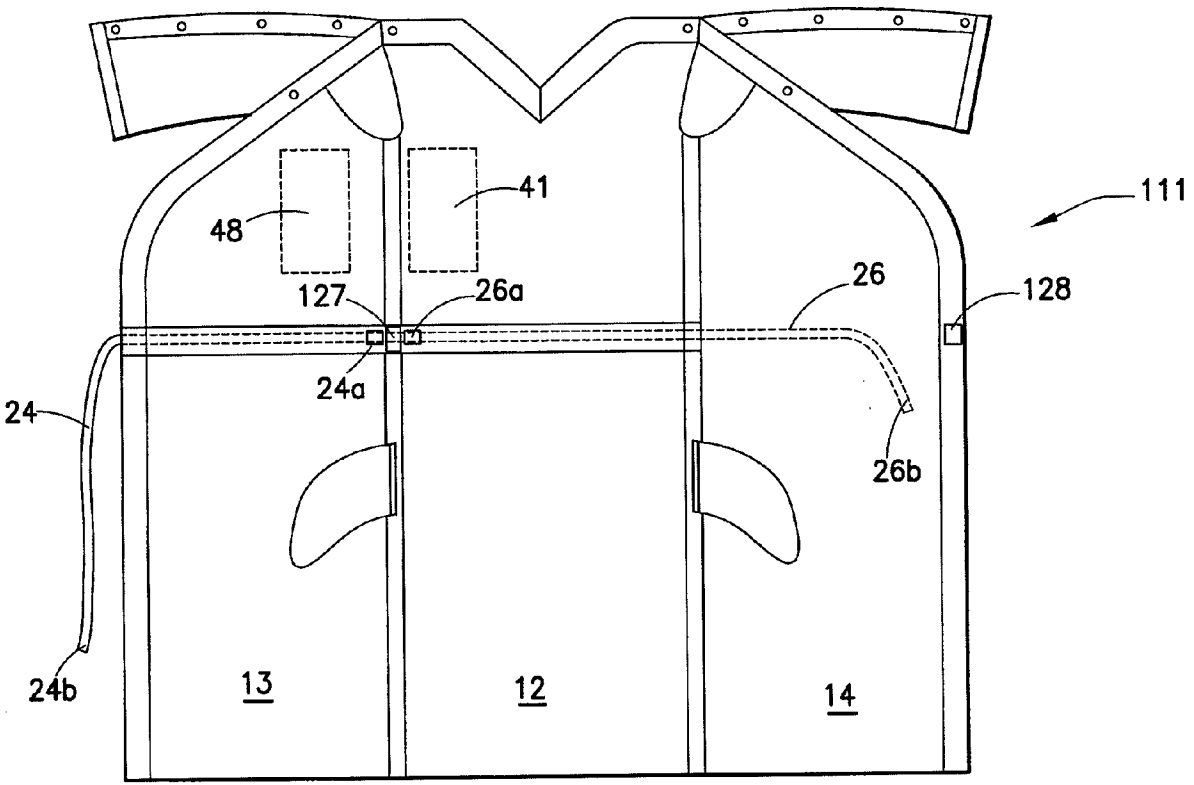
FIG. 6 is an inside plan view of a medical garment according to another embodiment of the invention.

FIG. 6 illustrates an alternative embodiment of a medical garment constructed and arranged in accordance with the invention. Here, a gown 111 similar to gown 11 of FIG. 1 has a pair of cooperating fasteners 127 and 128 in place of ties 27 and 28. All other elements are substantially identical to the embodiment of FIGS. 1-5 and have the same reference numerals. In this case, fasteners 127 and 128 are hook and loop fasteners that allow second panel 14 to be secured to the junction of central body panel 12 and first side panel 13 in a secure and convenient manner. Once fasteners 127 and 128 are secured, first side panel 13 is placed over second side panel 14 and belts 24 and 26 are tied as described in connection with the embodiment of FIG. 1.

While aspects of the present invention have been particularly shown and described with reference to the preferred embodiment above, it will be understood by those of ordinary skill in the art that various additional embodiments may be contemplated without departing from the spirit and scope of the present invention. For example, the first and second ties 27 and 28 or fasteners 127 and 128 could be omitted, with the second side panel 14 merely drawn or laid across the patient's body, to be held in place by friction with the overlapping first side panel 12. A device or method incorporating any of these features should be understood to fall under the scope of the present invention as determined based upon the claims below and any equivalents thereof.

Other aspects, objects, and advantages of the present invention can be obtained from a study of the drawings, the disclosure, and the appended claims.

What is claimed is:

1. A medical garment to be worn by a patient, comprising:

at least one fabric piece having an inside surface and an outside surface, the fabric piece having a middle region, a first side region having an outside edge and a width from the middle region to the outside edge, and a second side region having an outside edge and a width from the middle region to the outside edge;

a waistband extending across the middle region and the first side region to the outside edge thereof and having a first opening on the outside edge of the first side region, the waistband having a second opening on the outside surface of the fabric piece between the middle region and the second region;

a first belt member having a first end and a second end, at least a portion of the first belt member being located within the waistband, with the first end secured between the middle region and first side region and the second end exiting and extending from the first opening of the waistband;

a second belt member having a first end and a second end, at least a portion of the second belt member being located within the waistband, with the first end secured between the middle region and first side region and the second end exiting and extending from the second opening of the waistband; and wherein the first belt member and the second belt member are configured and dimensioned to allow a user to pull the second side region across the patient's body and the first side region across the second side region and releasably secure the second end of the first belt member to the second end of the second belt member, thereby adjustably and releasably securing the fabric substantially around the patient's body, and wherein the width of the first side region is substantially equal to the width of the second region.

2. The garment of claim 1, further including a first sleeve formed between the middle region and the first side region and a second sleeve formed between the middle region and the second side region.

3. The garment of claim 1, further including a first securement member mounted to the inside surface of the fabric piece between the middle region and first side region and a second securement member mounted to the outer edge of the second side region at the height of the waistband for securing the second side region across the patient's body and attaching the second side region to the junction of the middle region and first side region prior to draping the first side region over the second side region.

4. The garment of claim 3 wherein the first securement member and the second securement member are each ties having longitudinally separated first and second ends with a chosen end of the securement member fixedly secured to the fabric piece.

5. The garment of claim 3, wherein the first securement member and second securement member are fasteners.

6. The garment of claim 5, wherein the fasteners are hook and loop fasteners.

7. The garment of claim 2, wherein the sleeves are formed with longitudinal slits to provide access to a patient's arms.

8. The garment of claim 7, wherein the slits have selectively operable fastener elements.

9. The garment of claim 8, wherein the fastener elements are snaps.

10. The garment of claim 8, wherein the fastener elements are hook and loop fasteners.

11. The garment of claim 1, wherein the middle region and first and second side regions are separate pieces of fabric.

12. The garment of claim 11, wherein the separate pieces of fabric are sewn together.

13. A medical garment, comprising:

a central body fabric panel having an inside surface and an outside surface with a first side edge and a second side edge;

a first side fabric panel having an inside edge, an outside edge, and a width between the inside edge and the outside edge; and a second side fabric panel having an inside edge, an outside edge, and a width between the inside edge and the outside edge;

the central body fabric panel joined to the inside edges of the first and second side fabric panels;

a first armhole formed between the first side edge of the central body fabric panel and the inside edge of the first side fabric panel;

a second armhole formed between the second side edge of the central body fabric panel and the inside edge of the second side fabric panel;

a first sleeve attached to the first armhole;

a second sleeve attached to the second armhole;

a waistband extending across the central body fabric panel and the first side fabric panel to the outside edge of the first side fabric panel, the waistband having a first opening on the outside edge of the first side fabric panel and a second opening on the outside surface of the central body fabric body panel between the central body fabric panel and the second side fabric panel;

a first belt member, at least partially located within the waistband and secured therein between the central body and first side panel, the first belt member extending from the first opening of the waistband;

a second belt member, at least partially located within the waistband and secured therein between the central body panel and first side panel, the second belt member extending from the second opening of the waistband; and a first securement member mounted to the inside surface of the central body fabric between the central body fabric panel and first side fabric panel and a second securement member mounted to the outer edge of the second side fabric panel at the height of the waistband, the first and second securement members configured to secure the second side panel to the junction between the central body panel and first side panel after the second side panel is pulled across the patient's body;

wherein the first belt member and the second belt member are configured and dimensioned to allow a user to pull the second side fabric panel across the patient's body, place the first side fabric panel over the second side fabric panel and releasably secure the first belt member to the second belt member, thereby adjustably and releasably securing the garment fabric substantially around the patient's body, and wherein the width of the first side fabric panel is substantially equal to the width of the second side fabric panel.

14. The medical garment of claim 13, wherein each sleeve has a slit along the length thereof and a plurality of fasteners along the length of the slit with the slit selectively closeable by closing the fasteners.

15. The medical garment of claim 13, wherein each securement member is a tie having a first end and a second end longitudinally separated from each other with one end secured to at least one of the central, first side, and second side fabric panels.

16. The medical garment of claim 13, wherein each securement member is a fastener.

17. The medical garment of claim 16, wherein each securement member is a hook and loop fastener.

18. The garment of claim 1, wherein, when the fabric is secured adjustably and releasably substantially around the patient's body, the middle region is worn on a back side of the patient and at least one of the first and second side regions are worn on a front side of the patient.

19. The medical garment of claim 13, wherein, when the garment fabric is secured adjustably and releasably substantially around the patient's body, the central body panel is worn on a back side of the patient and at least one of the first and second panels are worn on a front side of the patient.

20. The medical garment of claim 1 wherein the middle region has a v-neck in a top edge and wherein the first and second side regions combine to form a v-neck when releasable secured substantially around the patient's body.

* * * * *